US006198060B1

(12) United States Patent
Yamazaki et al.

(10) Patent No.: US 6,198,060 B1
(45) Date of Patent: Mar. 6, 2001

(54) EL-COMBINED SHEET SWITCH

(75) Inventors: Hiroshi Yamazaki, Urawa; Koji Hirose, Chiba, both of (JP)

(73) Assignee: Seiko Precision, Inc. (JP)

( * ) Notice: Subject to any disclaimer, the term of this patent is extended or adjusted under 35 U.S.C. 154(b) by 0 days.

(21) Appl. No.: 09/307,952

(22) Filed: May 10, 1999

(51) Int. Cl.[7] ..... H01H 9/02
(52) U.S. Cl. ..... 200/305; 200/314
(58) Field of Search ..... 200/512, 292, 200/305, 314

(56) References Cited

U.S. PATENT DOCUMENTS

| | | | | |
|---|---|---|---|---|
| 4,786,767 | | 11/1988 | Kuhlman . | |
| 5,149,923 | * | 9/1992 | Demeo | 200/5 A |
| 5,315,204 | * | 5/1994 | Park | 310/399 |
| 5,399,823 | * | 3/1995 | McCusker | 200/521 |
| 5,557,079 | | 9/1996 | Jackson et al. . | |
| 5,661,279 | | 8/1997 | Kenmochi . | |
| 5,664,667 | | 9/1997 | Kenmochi . | |
| 5,669,486 | * | 9/1997 | Shima | 200/314 |
| 5,781,088 | * | 2/1999 | Tanabe | 200/514 |
| 5,844,166 | * | 12/1998 | Halttunen et al. | 174/35 R |
| 5,924,555 | * | 7/1999 | Sadmori et al. | 200/512 |

FOREIGN PATENT DOCUMENTS 2307105 5/1997 (GB) .

* cited by examiner

*Primary Examiner*—Lincoln Donovan
*Assistant Examiner*—Nhung Nguyen
(74) *Attorney, Agent, or Firm*—Amster, Rothstein & Ebenstein

(57) ABSTRACT

An EL-combined sheet switch including a circuit board having a driving circuit mounted on its back surface and having a switch pattern formed on its front surface in combination with a contact sheet having a counter electrode on its back surface in such a manner that the counter electrode faces the switch pattern to construct a switch mechanism. On the front surface of the contact sheet is attached an EL sheet and a shield layer is provided between the contact sheet and the EL sheet. In the EL-combined sheet switch, as described, the electromagnetic noise from the EL sheet which might otherwise affect the operation of an electronic device is blocked by the shield layer. The shield layer is preferably connected with a ground electrode formed on the circuit board.

5 Claims, 2 Drawing Sheets

FIG.1
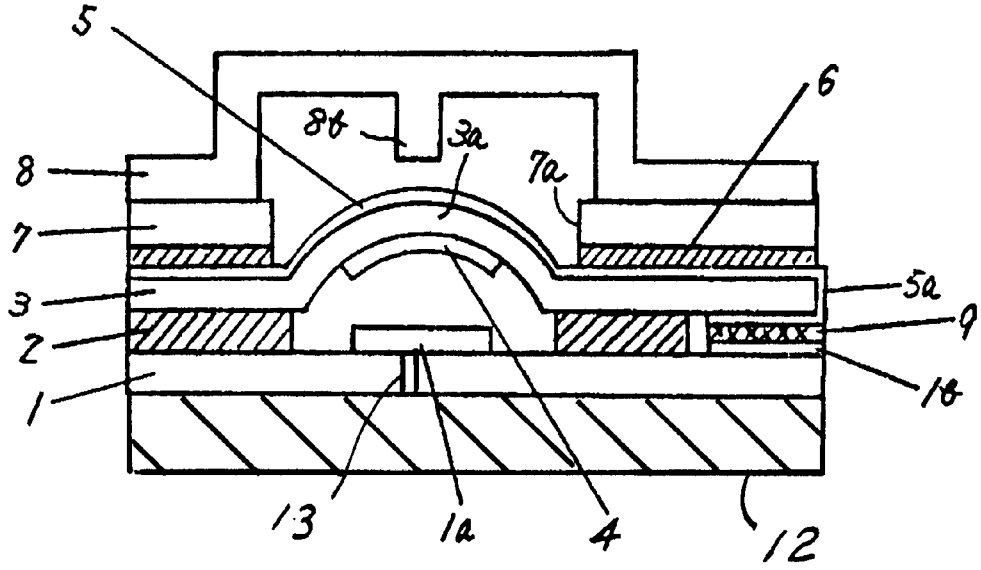
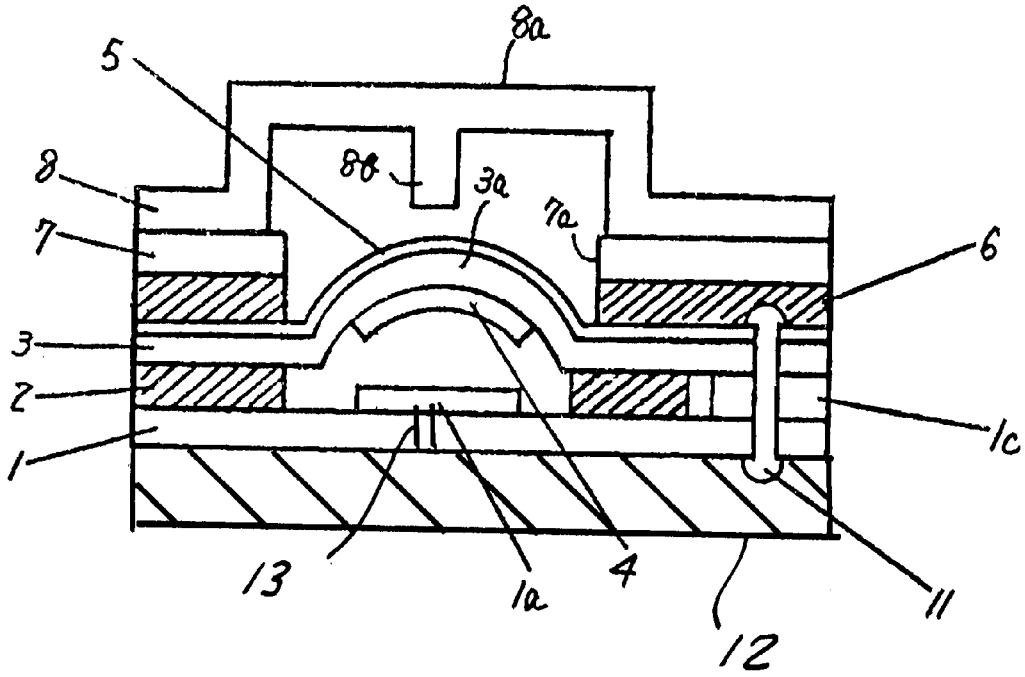
FIG.2

EL-COMBINED SHEET SWITCH

BACKGROUND OF THE INVENTION

1. Field of the Invention:

The present invention relates to an EL-combined sheet switch to be used, for example, in an inputting device for portable telephones, electronic pocket-books, etc.

2. Description of the Related Art

Portable appliances such as portable telephones, electronic pocketbooks, notebook-type personal computers, etc., in which an additional backlight is provided in the switch key area so as to facilitate the key operation even in the dark are known.

For example, in a portable telephone, a thin EL device is disposed as the backlight source in the side of the back surface of a switch key board. Through-holes are provided in the site of the EL device that correspond to switch keys. In this construction, when a switch key is pressed at its front surface, it is electrically connected with the EL device through the through-hole, and after the pressure is released, the electric connection is cut off. In this manner, the switch keys are lighted through light emission around the through-holes, allowing the keys to be differentiated even in the dark.

Ordinary EL devices emit light in the electric field of an alternating current, and generate electromagnetic noise. Therefore, electronic appliances equipped with an EL-combined sheet switch will often malfunction because of the electromagnetic noise generated by the EL device.

SUMMARY OF THE INVENTION

To solve the problems noted above, the EL-combined sheet switch of the present invention comprises a shield layer between the contact sheet and the EL sheet, in which the electromagnetic noise from the EL sheet is shielded by the shield layer to prevent the malfunction of the sheet switch. In the EL-combined sheet switch, the contact sheet is provided with a counter electrode that faces the switch pattern formed on the circuit board, and the counter electrode is capable of being detachably contacted with the switch pattern. The switching operation is therefore achieved through the contact and release of the switch pattern and the counter electrode that faces it. In the EL-combined sheet switch of the invention, the shield layer as provided between the contact sheet and the EL sheet shields the contact sheet from the electromagnetic waves running from the EL device. As a result, the electronic appliances equipped with the EL-combined sheet switch are prevented from malfunctioning.

Preferably, the shield layer is connected with the ground electrode formed on the circuit board.

BRIEF DESCRIPTION OF THE DRAWINGS

FIG. 1 is a cross-sectional view showing the construction of one embodiment of the invention.

FIG. 2 is a cross-sectional view showing the construction of another embodiment of the invention.

DETAILED DESCRIPTION OF THE INVENTION

Figure 3:
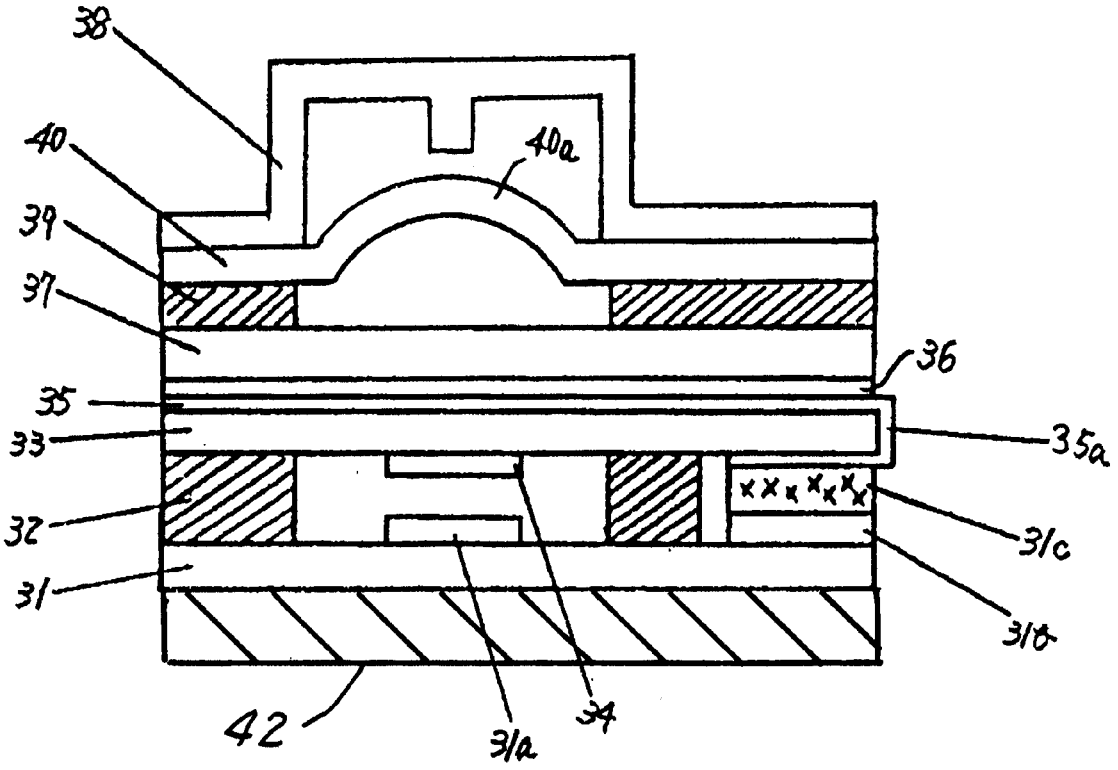
FIG. 3 is a cross-sectional view showing the construction of still another embodiment of the invention.

The EL-combined sheet switch of the invention comprises a circuit board with a driving circuit mounted thereon, a flexible contact sheet and an EL sheet as laminated in that order. The circuit board is provided with a switch pattern as formed on its surface that faces the contact sheet; and the contact sheet is provided with a counter electrode that faces the switch pattern. The counter electrode can be detachably contacted with the switch pattern. Between the contact sheet and the EL sheet, is provided a shield layer capable of shielding the contact sheet from the electromagnetic noise generated by the EL sheet. Preferably, the shield layer is connected with the ground electrode formed on the circuit board.

DESCRIPTION OF THE PREFERRED EMBODIMENTS

The EL-combined sheet switch of the invention is preferably used for the ten keys in portable electronic appliances such as portable telephones, electronic pocket-books, etc., and it comprises an EL sheet 7 by which the letters and the symbols on the key tops are visible even in the dark.

FIG. 1 shows the construction of one embodiment of the invention. As shown, the circuit board 1 is preferably a thin insulating board, and a driving circuit 12 for a portable electronic appliance is mounted on the back surface (lower side in FIG. 1) of the circuit board 1 while a contact sheet 3 is provided on the front surface (upper side in FIG.1) thereof via an adhesive layer 2 therebetween.

On the front surface of the circuit board 1 is formed a switch pattern 1*a*. The switch pattern 1*a* acts as a contact point for switching, and is preferably formed through printing with an ink that comprises carbon, silver or any other metal with high conductivity. The driving circuit 12 formed on the back surface of the circuit board 1 is electrically connected with the switch pattern 1*a* formed on the front surface of the circuit board 1 via a conductive through-hole 13.

The adhesive layer 2 is preferably of a non-conductive, polyethyl acetate or polyvinyl acetate-based adhesive, via which the circuit board 1 and the contact sheet 3 are bonded to each other. The contact sheet 3 is preferably of a PET (polyethylene terephihalate) sheet, and has an elastic dome part 3*a* that swells toward the front surface to be in a semi-spherical form, at a position which corresponds with the switch pattern 1*a*. Therefore, when its top is pushed down from its outside, the dome part 3*a* is elastically deformed, and its inner surface reaches the circuit board 1. After the pushing force is released, the dome part 3*a* is then restored to its original position.

At the ceiling of the dome part 3*a*, a counter electrode 4 is formed that faces the switch pattern 1*a*. The counter electrode 4 is formed through printing with the same ink as that for the switch pattern 1*a*. The counter electrode 4 and the switch pattern 1*a* form a switch mechanism. When the top of the dome part 3*a* is pushed down from its outside and deformed downward, the counter electrode 4 contacts the switch pattern 1*a*, whereby the circuit for the switch pattern is electrically turned on to give an input signal to the electronic appliance. Next, when the pressure to the dome part 3 is released, then the switch pattern 1*a* is detached from the counter electrode 4. In that manner, the switch pattern 1*a* and the counter electrode 4 are detachably provided relative to each other.

A shield layer 5 is preferably formed on the front surface of the contact sheet 3 through metal vapor deposition with aluminum or the like. Alternatively, the shield layer 5 may be formed through spraying or printing with an ink as prepared by mixing and kneading a conductive substance such as carbon, silver or the like with a binder.

An EL sheet 7 is attached to the front surface of the shield layer 5, with an adhesive layer 6. The adhesive layer 6 may be made of the same material as that of the adhesive layer 2. A through hole 7*a* is formed in the EL sheet 7, in the site corresponding to the dome part 3*a*. The cross-sectional area of the through-hole 7*a* is larger in some degree than the projected area of the dome part 3*a* to permit the swollen part of the dome part 3*a* to extend out above the front surface of the EL sheet 7.

A switch key board 8 is fitted to the front surface of the EL sheet 7. The switch key board 8 is preferably a molding of a rubber-based flexible elastic material, in which is formed a pushing part 8*a* in the area that faces the through-hole 7*a* of the EL sheet 7. The pushing part 8*a* protrudes toward the front surface. On the front surface of the pushing part 8*a*, are provided any of numerals, letters, symbols, etc. These numerals and others are semi-transparent relative to the black background around them, and are seen through light irradiation from the back side, while being differentiated from the black background around them. At the center of the ceiling inside the pushing part 8*a*, is formed a pushing projection 8*b* that protrudes downward. When the pushing part 8*a* is pushed from the outside, the pushing projection 8*b* pushes the top of the dome part 3*a* whereby the counter electrode 4 is contacted with the switch pattern 1*a*. When the pressure to the pushing part 8*a* is released, the pushing projection 8*b* is restored to its original position.

The shield layer 5 is described in more detail. In FIG. 1, the shield layer 5 as formed on the upper surface of the contact sheet 3 wraps around one side (right side in FIG. 1) of the contact sheet 3, and extends to a predetermined site on the back surface of the contact sheet 3 to form a back conductive part 5*a*. Between the back surface of the contact sheet 3, on which the back conductive part 5*a* is positioned, and the ground electrode 1*b* formed on the front surface of the circuit board 1, and adhesive layer 2 is removed, and the back conductive part 5*a* is electrically connected with the ground electrode 1*b* via a conductive adhesive 9 provided therebetween. The ground electrode 1*b* is grounded with a lead wire (not shown), and the electromagnetic noise having entered the shield layer 5 is led away through the back conductive part 5*a* and the ground electrode 1*b*. Alternatively, the electric connection of the back conductive part 5*a* with the ground electrode 1*b* may be made by a hot melt, in place of the conductive adhesive 9.

Another embodiment of the invention is described with reference to FIG. 2. As in FIG. 2, the basic structure of this embodiment is the same as that of the embodiment illustrated in FIG. 1. In FIG. 2, therefore, the same parts as those in FIG. 1 are designated by the same numeral references as in FIG. 1. In this embodiment, the shield layer 5 does not run to the back surface of the contact sheet 3. Instead, a conductive member 11 is provided to extend between the front surface of the shield layer 5 and the back surface of the circuit board 1, by which the device is grounded. Specifically, the conductive member 11 is of a metallic screw of copper, silver or the like, by which the shield layer 5 is electrically connected with the ground electrode 1*c* formed on the front surface of the circuit board 1. With this construction, the shield layer 5 is grounded via the ground electrode 1*c*. In this embodiment, the shield layer 5 does not extend to the back surface of the contact sheet 3 and no conductive adhesive is needed between the contact sheet 3 and the ground electrode 1*c*. Therefore, this embodiment is advantageous in that the grounding structure therein is simplified and the production costs are reduced.

FIG. 3 shows the construction of still another embodiment of the invention. As illustrated, a contact sheet 33 is provided on the front surface of a circuit 42 board 31, on which is mounted a driving circuit for a portable electronic appliance, via an adhesive-coated spacer 32 between contact sheet 33 and circuit board 31. On the front surface of the circuit board 31, in an area where the spacer 32 is not provided, a counter electrode 34 is provided such that it faces the switch pattern 31*a*.

On the front surface of the contact sheet 33, a shield layer 35 is formed, and on the front surface of the shield layer 35, is provided an EL sheet 37 via an adhesive layer 36 therebetween. The EL sheet 37 does not have a through-hole for switching operation. In this embodiment, therefore, the production of the EL sheet is easy.

As further shown in FIG. 3, a switch sheet 40 is attached to the front surface of the EL sheet 37 via an adhesive layer 39 therebetween. The switch sheet 40 has the same construction as that of the contact sheet 3 in the embodiments previously described hereinabove (see FIGS. 1 and 2), and is provided with a dome part 40*a*.

On the front surface of the switch sheet 40, is provided a switch key board 38. As in the construction of FIG. 1, the shield layer 35 wraps around the contact sheet 33 to run to the back surface of the contact sheet 33 forming a back conductive part 35*a* which is connected with the ground electrode 31*b* via a conductive adhesive 31*c* therebetween. The details of the other construction in FIG. 3 are the same as those in FIG. 1.

In this embodiment, contact is made by depressing key 38 against the dome part 40*a* to deform the EL sheet 37, shield layer 35 and the contact sheet 33 downwardly. In turn, the counter electrode 34 which is carried by contact sheet 33 is driven into detachable contact with the switch pattern 31*a*.

As has been described in detail hereinabove, in the EL-combined sheet switch of the invention, a shield layer is provided between the contact sheet and the EL sheet, and the electromagnetic noise from the EL sheet is blocked by the shield layer. Therefore, electronic appliances provided with the EL-combined sheet switch of the invention are prevented from malfunctioning. Where the shield layer is connected with the ground electrode formed on the circuit board, the construction of the EL-combined sheet switch can be simplified.

While the invention has been described in detail and with reference to specific embodiments thereof, if will be apparent to one skilled in the art that various changes and modifications can be made therein without departing from the spirit and scope thereof.

What is claimed is:

1. An electro luminescent-combined sheet switch comprising a circuit board having an upper surface and a lower surface, with a driving circuit mounted on the lower surface of said circuit board, a flexible contact sheet, and an EL sheet as laminated in that order on the upper surface of said circuit board;

said circuit board being provided with a switch pattern on its upper surface that faces said flexible contact sheet, said flexible contact sheet being provided with a counter electrode that faces said switch pattern, said counter electrode detachably contacting said switch pattern when said flexible contact sheet is deformed in the direction of said switch pattern; and between said contact sheet and said electro-luminescent sheet is provided blocking electromagnetic noise from said electro-luminescent sheet.

2. The electro luminicent-combined sheet switch as claimed in claim 1, wherein said shield layer is connected with a ground electrode formed on said circuit board.

3. An electro luminescent-combined sheet switch comprising:

a circuit board having an upper surface and a lower surface, with a driving circuit mounted on the lower surface of said circuit board;

a flexible contact sheet adhered on the upper surface of said circuit board, said flexible contact sheet having an elastic dome part that swells away from said circuit board;

a shield layer adhered to said flexible contact sheet on the surface opposite the surface adhered to said circuit board;

an EL sheet adhered to the surface of said shield layer opposite the surface of the shield layer adhered to said flexible contact sheet, said shield layer provided for blocking the electromagnetic noise from said EL sheet;

said circuit board provided with a switch pattern on its upper surface that faces said flexible contact sheet; and said elastic dome part provided with a counter electrode that faces said switch pattern, said counter electrode detachably contacting said switch pattern when said dome part is deformed in the direction of said switch pattern.

4. The electro luminescent-combined sheet switch as claimed in claim 3, wherein said shield layer is connected with a ground electrode formed on said circuit board.

5. An electro luminescent-combined sheet switch comprising:

a circuit board;

a flexible contact sheet, and an EL sheet laminated in that order on said circuit board;

said circuit board provided with a switch pattern on a surface that faces said flexible contact sheet;

said flexible contact sheet provided with a counter electrode that faces said switch pattern; and a shield layer between said contact sheet and said electro-luminescent sheet is provided blocking electromagnetic noise from said electro-luminescent sheet.

* * * * *